US012662932B2

(12) United States Patent
Shetty et al.

(10) Patent No.: US 12,662,932 B2
(45) Date of Patent: Jun. 23, 2026

(54) SEQUENCE OF CONTINUOUS EXCITATIONS FOR GENERATING PRESSURE PULSE SIGNAL IN A WELL SYSTEM

(71) Applicant: Halliburton Energy Services, Inc., Houston, TX (US)

(72) Inventors: Dinesh Ananda Shetty, Houston, TX (US); Erik Lee, Houston, TX (US); Rajani Prakash Satti, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/920,381

(22) Filed: Oct. 18, 2024

(65) Prior Publication Data

US 2025/0369347 A1 Dec. 4, 2025

Related U.S. Application Data

(60) Provisional application No. 63/654,764, filed on May 31, 2024, provisional application No. 63/653,041, filed on May 29, 2024.

(51) Int. Cl.
*E21B 47/12* (2012.01)
*E21B 43/26* (2006.01)

(52) U.S. Cl.
CPC ..... *E21B 47/12* (2013.01); *E21B 43/26* (2013.01)

(58) Field of Classification Search
CPC ..... E21B 43/25; E21B 43/255; E21B 43/26; E21B 43/2605; E21B 43/2607;
(Continued)

(56) References Cited

U.S. PATENT DOCUMENTS 4,899,320 A 2/1990 Hearn et al.
4,993,491 A 2/1991 Palmer et al.
(Continued)

FOREIGN PATENT DOCUMENTS

CA 3221947 1/2018
CA 3034253 1/2021
(Continued)

OTHER PUBLICATIONS

"PCT Application No. PCT/US2025/014878 International Search Report and Written Opinion", May 26, 2025, 10 pages.
(Continued)

*Primary Examiner* — Franklin D Balseca
(74) *Attorney, Agent, or Firm* — DeLizio, Peacock, Lewin & Guerra LLP

(57) ABSTRACT

Systems, methods, and apparatus, including computer programs encoded on computer-readable media, for generating pressure signals in a wellbore of a well system. A target amplitude may be determined for a target pressure signal to be generated in the wellbore of the well system. A rate drop step size may be determined for each rate drop of a plurality of rate drops. During fracturing operations in the well system, the plurality of rate drops may be performed in sequence for a system operational rate to generate the target pressure signal. Each rate drop of the plurality of rate drops may have the rate drop step size. One or more fracturing operation metrics may be determined for the well system from the target pressure signal.

20 Claims, 7 Drawing Sheets

(58) Field of Classification Search
CPC ..... E21B 43/27; E21B 47/12; E21B 47/14; E21B 47/18; E21B 47/20; E21B 47/22; E21B 47/24
See application file for complete search history.

(56) References Cited

U.S. PATENT DOCUMENTS

| | | | | |
|---|---|---|---|---|
| 5,295,393 | A | 3/1994 | Thiercelin | |
| 5,441,340 | A | 8/1995 | Cedillo et al. | |
| 6,439,310 | B1 | 8/2002 | Scott, III et al. | |
| 6,795,773 | B2 | 9/2004 | Soliman et al. | |
| 6,935,424 | B2 | 8/2005 | Lehman et al. | |
| 7,210,528 | B1 | 5/2007 | Brannon et al. | |
| 7,377,319 | B2 | 5/2008 | Patterson | |
| 7,451,812 | B2 | 11/2008 | Cooper et al. | |
| 7,451,820 | B2 | 11/2008 | Albers et al. | |
| 7,516,793 | B2 | 4/2009 | Dykstra | |
| 7,673,507 | B2 | 3/2010 | Walters et al. | |
| 7,938,181 | B2 | 5/2011 | Dusterhoft et al. | |
| 8,126,646 | B2 | 2/2012 | Grove et al. | |
| 8,528,649 | B2 * | 9/2013 | Kolle | E21B 28/00 166/321 |
| 9,135,475 | B2 | 9/2015 | Lecerf et al. | |
| 9,222,347 | B1 | 12/2015 | Walls et al. | |
| 9,441,470 | B2 | 9/2016 | Guerrero et al. | |
| 9,658,357 | B2 | 5/2017 | Kabannik et al. | |
| 9,803,467 | B2 | 10/2017 | Tang et al. | |
| 9,909,404 | B2 | 3/2018 | Hwang et al. | |
| 10,001,769 | B2 | 6/2018 | Huang et al. | |
| 10,400,550 | B2 | 9/2019 | Gu et al. | |
| 10,408,029 | B2 | 9/2019 | Rodrigues et al. | |
| 10,641,090 | B2 | 5/2020 | Felkl et al. | |
| 10,677,961 | B1 | 6/2020 | Chen et al. | |
| 10,689,971 | B2 | 6/2020 | Smith et al. | |
| 10,995,609 | B2 | 5/2021 | Felki et al. | |
| 11,199,084 | B2 | 12/2021 | Langnes et al. | |
| 11,230,915 | B2 | 1/2022 | Dusterhoft et al. | |
| 11,319,790 | B2 | 5/2022 | Potty et al. | |
| 11,320,551 | B2 | 5/2022 | Liu et al. | |
| 11,415,716 | B2 | 8/2022 | Clark et al. | |
| 11,434,738 | B1 | 9/2022 | Han | |
| 11,518,931 | B2 | 12/2022 | Duncan et al. | |
| 11,608,740 | B2 | 3/2023 | Moos et al. | |
| 11,649,696 | B2 | 5/2023 | Angman et al. | |
| 11,668,168 | B2 | 6/2023 | Parsegov et al. | |
| 11,702,931 | B2 | 7/2023 | Inyang et al. | |
| 11,704,557 | B2 | 7/2023 | Moniruzzaman et al. | |
| 11,708,759 | B2 * | 7/2023 | Jaaskelainen | E21B 49/00 166/250.1 |
| 11,753,917 | B2 | 9/2023 | Shetty et al. | |
| 11,753,923 | B2 | 9/2023 | Dalamarinis | |
| 11,762,115 | B2 | 9/2023 | Quan et al. | |
| 11,767,751 | B2 | 9/2023 | Coenen et al. | |
| 11,808,145 | B2 | 11/2023 | Fripp et al. | |
| 11,879,317 | B2 | 1/2024 | Hunter et al. | |
| 12,006,819 | B2 | 6/2024 | Cramer | |
| 12,037,899 | B2 * | 7/2024 | Swan | E21B 43/26 |
| 12,486,747 | B1 | 12/2025 | Jeremic et al. | |
| 2006/0034152 | A1 | 2/2006 | Korneev et al. | |
| 2007/0007003 | A1 | 1/2007 | Jackson et al. | |
| 2010/0314104 | A1 | 12/2010 | Shokanov et al. | |
| 2013/0079935 | A1 | 3/2013 | Kabannik et al. | |
| 2014/0222392 | A1 | 8/2014 | Johnson et al. | |
| 2016/0222741 | A1 | 8/2016 | Lovorn et al. | |
| 2016/0266276 | A1 | 9/2016 | Stokely et al. | |
| 2017/0138150 | A1 | 5/2017 | Yencho | |
| 2017/0342823 | A1 | 11/2017 | Shah et al. | |
| 2018/0210105 | A1 | 7/2018 | Stokely | |
| 2019/0029884 | A1 | 1/2019 | Jonkheere et al. | |
| 2019/0129047 | A1 | 5/2019 | Clark et al. | |
| 2019/0136684 | A1 | 5/2019 | Felkl et al. | |
| 2019/0146115 | A1 | 5/2019 | Mayo et al. | |
| 2019/0310386 | A1 | 10/2019 | Quan et al. | |
| 2019/0338619 | A1 | 11/2019 | Bois | |
| 2020/0063533 | A1 | 2/2020 | Annaiyappa | |
| 2020/0308958 | A1 | 10/2020 | Kabannik et al. | |
| 2021/0032967 | A1 | 2/2021 | Dusterhoft et al. | |
| 2021/0040841 | A1 | 2/2021 | Dusterhoft et al. | |
| 2021/0073342 | A1 | 3/2021 | Razavi et al. | |
| 2021/0131254 | A1 | 5/2021 | Potty et al. | |
| 2021/0140312 | A1 | 5/2021 | Dumoit et al. | |
| 2021/0189874 | A1 | 6/2021 | Jaaskelainen et al. | |
| 2021/0277760 | A1 | 9/2021 | Stephenson et al. | |
| 2021/0301657 | A1 | 9/2021 | Gordon et al. | |
| 2021/0302612 | A1 | 9/2021 | Venkatakrishnan et al. | |
| 2021/0396117 | A1 | 12/2021 | Yeung et al. | |
| 2021/0406792 | A1 | 12/2021 | Bhardwaj et al. | |
| 2022/0120173 | A1 | 4/2022 | Balan et al. | |
| 2022/0145742 | A1 | 5/2022 | Dalamarinis et al. | |
| 2022/0186605 | A1 | 6/2022 | Quan et al. | |
| 2022/0228484 | A1 | 7/2022 | Cramer | |
| 2022/0307371 | A1 | 9/2022 | Swan | |
| 2022/0325621 | A1 | 10/2022 | Moos et al. | |
| 2022/0364429 | A1 | 11/2022 | Burke et al. | |
| 2023/0009947 | A1 | 1/2023 | Ruhle et al. | |
| 2023/0066612 | A1 | 3/2023 | Parsegov et al. | |
| 2023/0086213 | A1 | 3/2023 | Yeung et al. | |
| 2023/0120763 | A1 | 4/2023 | Ray | |
| 2023/0147476 | A1 | 5/2023 | Wheelock et al. | |
| 2023/0228185 | A1 | 7/2023 | Dunham et al. | |
| 2023/0235635 | A1 | 7/2023 | Li et al. | |
| 2023/0243231 | A1 | 8/2023 | Zakharia et al. | |
| 2023/0296800 | A1 | 9/2023 | Zheng et al. | |
| 2023/0383639 | A1 | 11/2023 | Sridhar et al. | |
| 2023/0417940 | A1 | 12/2023 | Rose et al. | |
| 2024/0060410 | A1 | 2/2024 | Gunaratne et al. | |
| 2024/0077071 | A1 | 3/2024 | Mu et al. | |

FOREIGN PATENT DOCUMENTS

| | | |
|---|---|---|
| CA | 3034219 | 3/2023 |
| CN | 114152977 | 1/2023 |
| WO | 2009096805 | 8/2009 |
| WO | 2018022044 | 2/2018 |
| WO | 2018084871 | 5/2018 |
| WO | 2018111231 | 6/2018 |
| WO | 2021061567 | 4/2021 |

OTHER PUBLICATIONS

"PCT Application No. PCT/US2025/014882 International Search Report and Written Opinion", May 28, 2025, 10 pages.
"PCT Application No. PCT/US2024/053767 International Search Report and Written Opinion", Feb. 21, 2025, 10 pages.
"PCT Application No. PCT/US2024/053772 International Search Report and Written Opinion", Feb. 20, 2025, 10 pages.
"PCT Application No. PCT/US2024/053866 International Search Report and Written Opinion", Feb. 21, 2025, 11 pages.
"PCT Application No. PCT/US2024/054478 International Search Report and Written Opinion", Feb. 20, 2025, 9 pages.
"PCT Application No. PCT/US2024/054614 International Search Report and Written Opinion", Feb. 20, 2025, 10 pages.
"PCT Application No. PCT/US24/53771 International Search Report and Written Opinion", Feb. 25, 2025, 10 pages.
"PCT Application No. PCT/US2024/053099 International Search Report and Written Opinion", Feb. 20, 2025, 9 pages.
"PCT Application Serial No. PCT/US24/54479, International Search Report and Written Opinion", Feb. 19, 2025, 11 pages.
"U.S. Appl. No. 16/668,791 Final Office Action", Jul. 12, 21, 14 pages.
"U.S. Appl. No. 16/668,791 Non Final Office Action", Mar. 2, 2021, 12 pages.
Carey, et al., "Analysis of Water Hammer Signatures for Fracture Diagnostics", SPE Annual Technical Conference and Exhibition, Sep. 28-30, 2015,, 2015, 25 pages.
Chen, et al., "Research on recognition and classification of pulse signal features based on EPNCC", Scientific Reports vol. 12, Article No. 6731 (2022), 2022, 11 pages.
Cramer, et al., "Integrating Distributed Acoustic Sensing, Treatment-Pressure Analysis, and Video-Based Perforation Imaging to Evalu-

(56) References Cited

OTHER PUBLICATIONS ate Limited-Entry-Treatment Effectiveness", SPE Production and Operations, vol. 35, Issue 04, Nov. 2020, 2020, 26 pages.
Cramer, "The Application of Limited-Entry Techniques in Massive Hydraulic Fracturing Treatments", SPE Production Operations Symposium held in Oklahoma City, Oklahoma, Mar. 8-10, 1987, 1987, 18 pages.
Crump, et al., "Effects of Perforation-Entry Friction on Bottomhole Treating Analysis", JPT vol. 40, Issue 08, Aug. 1988, 1988, 8 pages.
Dung, et al., "Practical Applications of Water Hammer Analysis from Hydraulic Fracturing Treatments", SPE Hydraulic Fracturing Technology Conference and Exhibition, Virtual, May 2021, Apr. 27, 2021, 47 pages.
Dunham, et al., "Constraints on Pipe Friction and Perforation Cluster Efficiency from WaterHammer Analysis", SPE Hydraulic Fracturing Technology Conference and Exhibition, The Woodlands, Texas, USA, Jan. 31-Feb. 2, 2023., 2023, 12 pages.
Kotthoff, "Algorithm Selection for Combinatorial Search Problems: A Survey", AI Magazine, 35 (3), 2014, 37 pages.
Long, et al., "A Perforation-Erosion Model for Hydraulic-Fracturing Applications", SPE Annual Technical Conference and Exhibition, Houston, Sep. 28-30, 2015, 2015, 15 pages.
Martins, et al., "Communication Models for Distributed Acoustic Sensing for Telemetry", IEEE Sensors Journal, vol. 17, No. 15, Aug. 1, 2017, 2017, 12 pages.
"U.S. Appl. No. 18/919,064 Non-Final Office Action", Sep. 5, 2025, 7 pages.
"U.S. Appl. No. 18/920,483 Non-Final Office Action", Sep. 25, 2025, 15 pages.
"U.S. Appl. No. 18/920,567 Non-Final Office Action", Jul. 15, 2025, 11 pages.

* cited by examiner

SEQUENCE OF CONTINUOUS EXCITATIONS FOR GENERATING PRESSURE PULSE SIGNAL IN A WELL SYSTEM

TECHNICAL FIELD

The present invention relates generally to oil and gas systems and services, and more specifically to generating a pressure pulse signal in a well system from a sequence of continuous excitations.

BACKGROUND

In the oil and gas industry, hydraulic fracturing ("fracking") is a common method used to increase permeability and thus productivity of the reservoirs. The fracturing operations and other related operations are performed in a well system at a certain operational rate. For example, the operational rate may include the rate at which the fracturing fluid is pumped to perform the fracturing operations. The operational rate of the fracturing operations may be adjusted as necessary. After performing one or more fracturing operations and related processes, pressure signals may be generated in the wellbore for use in analyzing the results of the fracturing operations.

DESCRIPTION

The description that follows includes example systems, methods, techniques, and program flows that describe aspects of the disclosure. However, it is understood that this disclosure may be practiced without these specific details. For instance, this disclosure refers to certain well systems, devices, or tools in illustrative examples. Aspects of this disclosure can be instead applied to other types of well systems, devices, and tools. In other instances, well-known instruction instances, protocols, structures, and techniques have not been shown in detail to avoid confusion.

Figure 1:
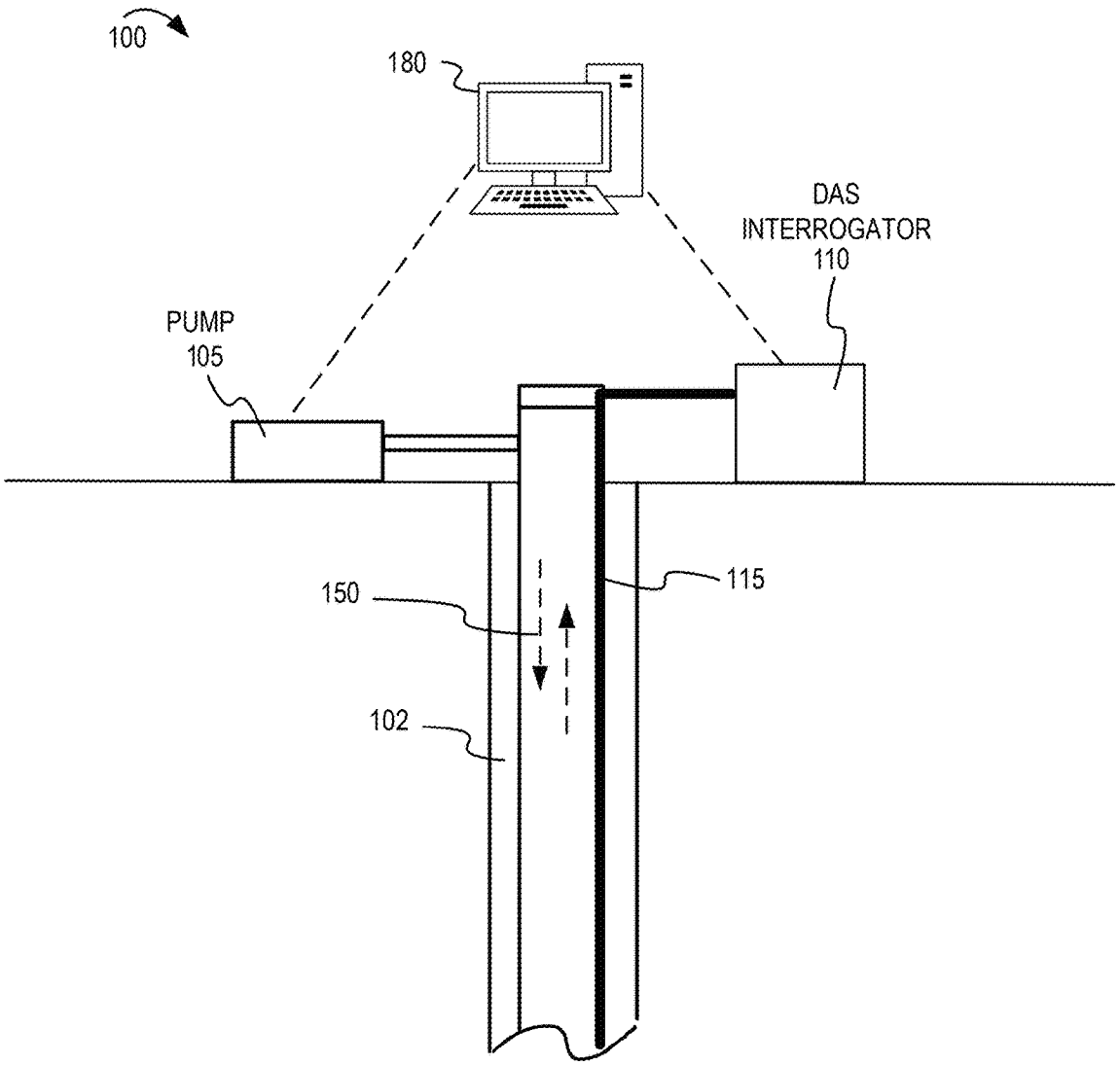
FIG. 1 depicts a schematic diagram of an example well system configured to perform a sequence of rate drops to generate a target pressure signal, according to some implementations.

FIG. 1 depicts a schematic diagram of an example well system 100 configured to perform a sequence of rate drops to generate a target pressure signal, according to some implementations. In some implementations, the well system 100 may include a wellbore 102, a pump 105, a distributed acoustic sensing (DAS) interrogator 110, a fiber optic cable 115, and a computer system 180. It is noted that the well system 100 may include additional devices, tools and other components that are not shown for simplicity. In some implementations, the fiber optic cable 115 may be temporarily deployed and may be removable from the well. In some implementations, the fiber optic cable 115 may be permanently installed in the well. The fiber optic cable 115 may be connected at the opposite end to well equipment, such as the DAS interrogator 110. In some implementations, the well system 100 may perform fracturing operations, such as hydraulic fracturing operations, for extracting reservoir fluid (e.g., hydrocarbons such as oil and gas) from the subsurface formation. During a hydraulic fracturing operations of the well system 100, one or more pumps (such as the pump 105) may pump fracturing fluid or fracturing treatments, with or without sand, into the subsurface formation via perforations in the wellbore 102 to hydraulically fracture the rock of the subsurface formation, such that the reservoir fluid may flow into the wellbore 102 for extraction. In some implementations, one or more sensors may be positioned in the wellbore 102 to obtain measurements, such as pressure measurements, during the fracturing operations. The fiber optic cable 115 may perform some of the sensing and measurement operations and/or the well system 100 may have other wellbore sensors for obtaining the measurements. Additional details of the well system 100 and the fracturing operations are described further in FIG. 7.

The well system 100 may be running and performing the fracturing operations at an operational rate (which may also be referred to as a system operational rate). For example, the operational rate may be a certain number of barrels per minute (bpm). In some implementations, the well system 100 may be configured to perform a sequence of rate drops to generate a target pressure signal 150 in the wellbore 102. The sequence of rate drops may be referred to as a sequence of continuous excitations in the wellbore 102 for generating the target pressure signal 150. In some implementations, the target pressure signal 150 may include one or more water hammer pressure pulses arising from hydraulic fracturing operations. In some implementations, the target pressure signal 150 can be used to determine fracturing operation metrics for the well system 100, as further described below. For example, fracturing operation metrics that can be determined from the target pressure signal 150 may include stage efficiency metrics for the fracturing operation. In some implementations, after the target pressure signal 150 is generated, an inversion process may be performed to compute the fracturing operation metrics, such as the stage efficiency metrics for the fracturing operation, as further described below with reference to FIG. 4.

In some implementations, prior to performing the sequence of rate drops to generate the target pressure signal 150, the well system 100 (e.g., the computer system 180 in conjunction with one or more sensors) may analyze the current pressure signal to determine whether the current pressure signal has signal imprints (which may also be referred to as signal artifacts) from prior system actions or operations. For example, the signal imprints in the current pressure signal may have been caused by prior fracturing operations, prior rate drop operations, or other system actions or operations. If signal imprints are detected in the current pressure signal, the well system 100 may determine signal characteristics of the signal imprints. The well system 100 may remove or cancel the signal imprints from the current pressure signal based on the signal characteristics. For example, if the signal imprint is a pulse, the well system 100 may generate an equal and opposite pulse that can cancel out or remove the signal imprint. The well system 100 may remove or cancel the signal imprints from the current pressure signal prior to performing various measurements and operations to generate the target pressure signal 150.

Figure 2:
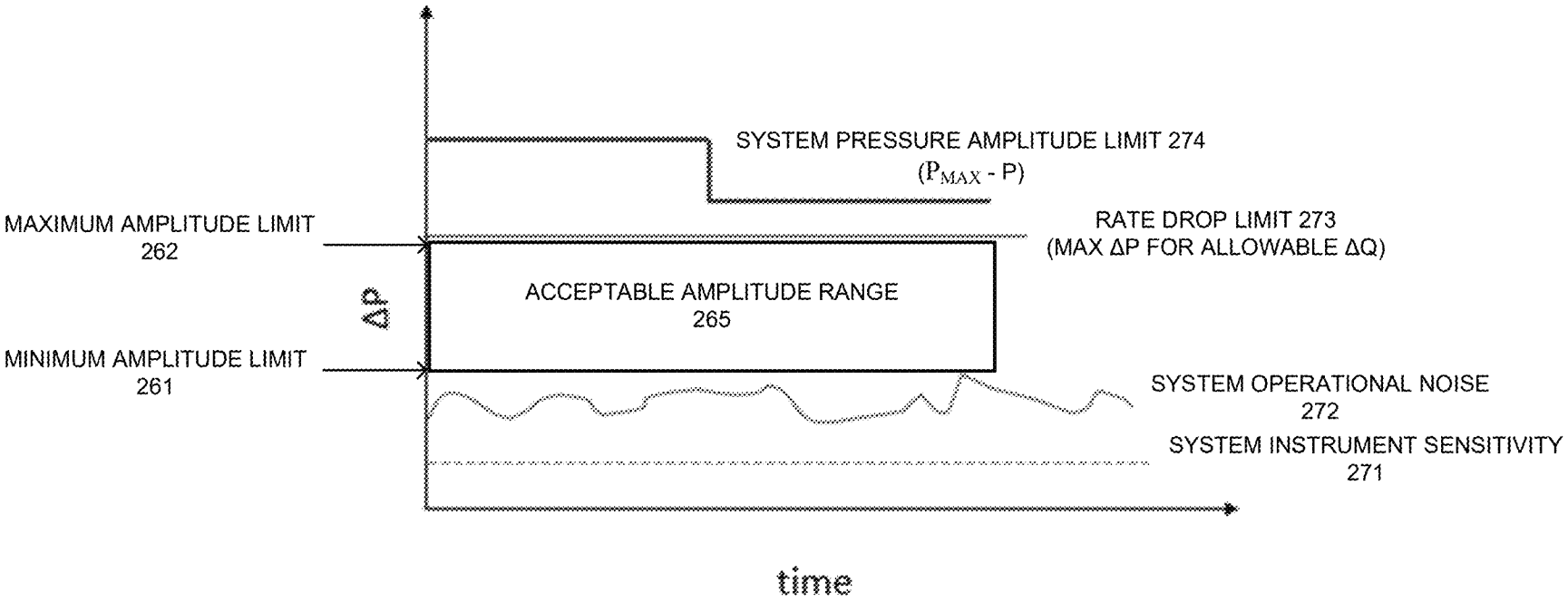
FIG. 2 depicts a plot of various pressure change related parameters that indicates an acceptable amplitude range for generating the target pressure signal having a target amplitude, according to some implementations.

In some implementations, the well system 100 may perform operations to determine a target amplitude for a target pressure signal 150 to be generated in the wellbore 102. In some implementations, the target amplitude of the target pressure signal 150 may be determined based on system instrument sensitivity 271, system operational noise 272, a rate drop limit 273, and a system pressure amplitude limit 274. For example, with reference to FIG. 2, a minimum amplitude limit 261 for the target pressure signal 150 may be determined based on the system instrument sensitivity 271 and the system operational noise 272, and the maximum amplitude limit 262 for the target pressure signal 150 may be determined based on the rate drop limit 273 and the system pressure amplitude limit 274. The target amplitude of the target pressure signal 150 may be selected from an acceptable amplitude range 265 having amplitude values in between the minimum amplitude limit 261 and the maximum amplitude limit 262, as shown in FIG. 2. In other words, the target amplitude that is selected is greater than the minimum amplitude limit 261 and less than the maximum amplitude limit 262.

The system operational noise 271 may be the inherent noise that is always present in the system during fracturing operations. The system instrument sensitivity 272 may indicate the inherent sensing limitations of well system instruments, such as sensitivity of the pressure sensors (e.g., the least count of the instrument). The rate drop limit 273 may indicate the rate fluctuations that are allowed during system operations, such as the rate fluctuations that are allowed during fracturing operations. In other words, the maximum allowable rate drop ($\Delta Q$) that is allowable during the fracturing operations indicates a maximum target amplitude (which corresponds to a maximum change in pressure (Max $\Delta P$)) that will be allowed for the target pressure signal. For example, if the well system 100 has an operational rate of 100 barrels per minute (bpm), the rate drop limit 273 may be 5 bpms or a rate drop to an operational rate of 95 bpm. The maximum rate drop may provide a maximum target amplitude for the target pressure signal, which may be determined using the Joukowsky relation, described below. The rate drop may be limited because when the operational rate is dropped, the fracturing operation time may increase. For example, when the operational rate is dropped, it takes more time to pump (e.g., using pump 105) a certain amount of fracturing fluid (i.e., decreases the pumping rate), and thus the fracturing time may be increased. The rate drop limit 273 may limit the increase in the fracturing operation time. The system pressure amplitude limit 274 may indicate the maximum target amplitude that will be allowable based on the current system pressure (P) and the maximum allowable system pressure ($P_{MAX}$). As a non-limiting example, the current system pressure may be 10,000 psi and the maximum allowable system pressure (e.g., system kick-out pressure) may be 11,000 psi. In this example, the system pressure amplitude limit 274, and thus the maximum target amplitude, should be selected to be less than a 1,000 psi amplitude to avoid exceeding the maximum allowable system pressure (e.g., system kick-out pressure).

As described above, in some implementations, mathematical models and equations may be used to determine the target amplitude for the target pressure signal 150. For example, Equation 1, Equation 2, and Equation 3 may be used for calculating the wave speed of a signal (such as a pressure pulse) based on the fluid and geometrical detail where the signal is created (such as the wellbore or the fracture), and knowing the stage depth to be able to compute the travel time of the wave.

$$\frac{1}{a^2} = \frac{d\rho}{dP} + \frac{\rho}{A}\frac{dA}{dP} \qquad \text{Equation 1}$$

In Equation 1, a is the waves speed, $\rho$ is density, P is pressure, and A is area. Equation 1 may be referred to as the general wave speed model. Equation 2 may be referred to as the wave speed model for a wellbore.

$$a^2 = \frac{1}{\frac{\rho}{K_f} + (1 - v^2)\frac{\rho D}{Et}} \qquad \text{Equation 2}$$

In Equation 2, a is the waves speed, $\rho$ is density, D is diameter, E is Young's Modulus, v is Poisson's ratio, t is thickness, and $K_f$ is coefficient of stiffness. Equation 3 may be referred to as the wave speed model for a fracture that is formed from the fracturing operations.

$$a^2 = \frac{\pi w G}{2\rho h_f (1 - v^2)} \qquad \text{Equation 3}$$

In Equation 3, a is the waves speed, $\rho$ is density, w is a fracture width, v is Poisson's ratio, $h_f$ is a fracture height, and G is a shear modulus. In addition to the wave speed models above in Equations 1-3, a change in pressure for the rate drops may be calculated using the Joukowsky relation shown in Equation 4. The Joukowsky relation indicates the amount of the change in pressure when there is some amount of change in velocity. In Equation 4, a is the speed of light, $\rho$ is density, P is pressure, and v is Poisson's ratio. $\Delta P$ may be a change in pressure or an amplitude of a pressure signal (e.g., such as the target amplitude for the target pressure signal 150). The Poisson's ratio v may be velocity based, and may also be substituted by the allowable rate drop ($\Delta Q$).

$$\Delta P = \rho * a * \Delta v \qquad \text{Equation 4}$$

As described above, the rate drop limit 273 may be determined based on the Joukowsky relation. For example, when the allowable $\Delta Q$ is substituted for $\Delta v$, Joukowsky relation provides the $\Delta P$, which can indicate the maximum $\Delta P$ for the allowable $\Delta Q$ for the well system 100. As shown in FIG. 2, the maximum amplitude limit 262 of the acceptable amplitude range 265 can be set to be less than the rate drop limit 273 (corresponding to the maximum $\Delta P$ for the allowable $\Delta Q$).

After determining the target amplitude for a target pressure signal 150, the well system 100 may determine a rate drop step size for each rate drop in a sequence of multiple rate drops. The rate drops may be a sequence of rate drops from the system operational rate drop of the well system 100. As a non-limiting example, if the operational rate is dropped from 100 bpm to 95 bpm for the target pressure signal 150, the rate drop step size for each rate drop in the sequence of rate drops may be a drop of 1 bpm for each of 5 consecutive rate drops.

Figure 3:
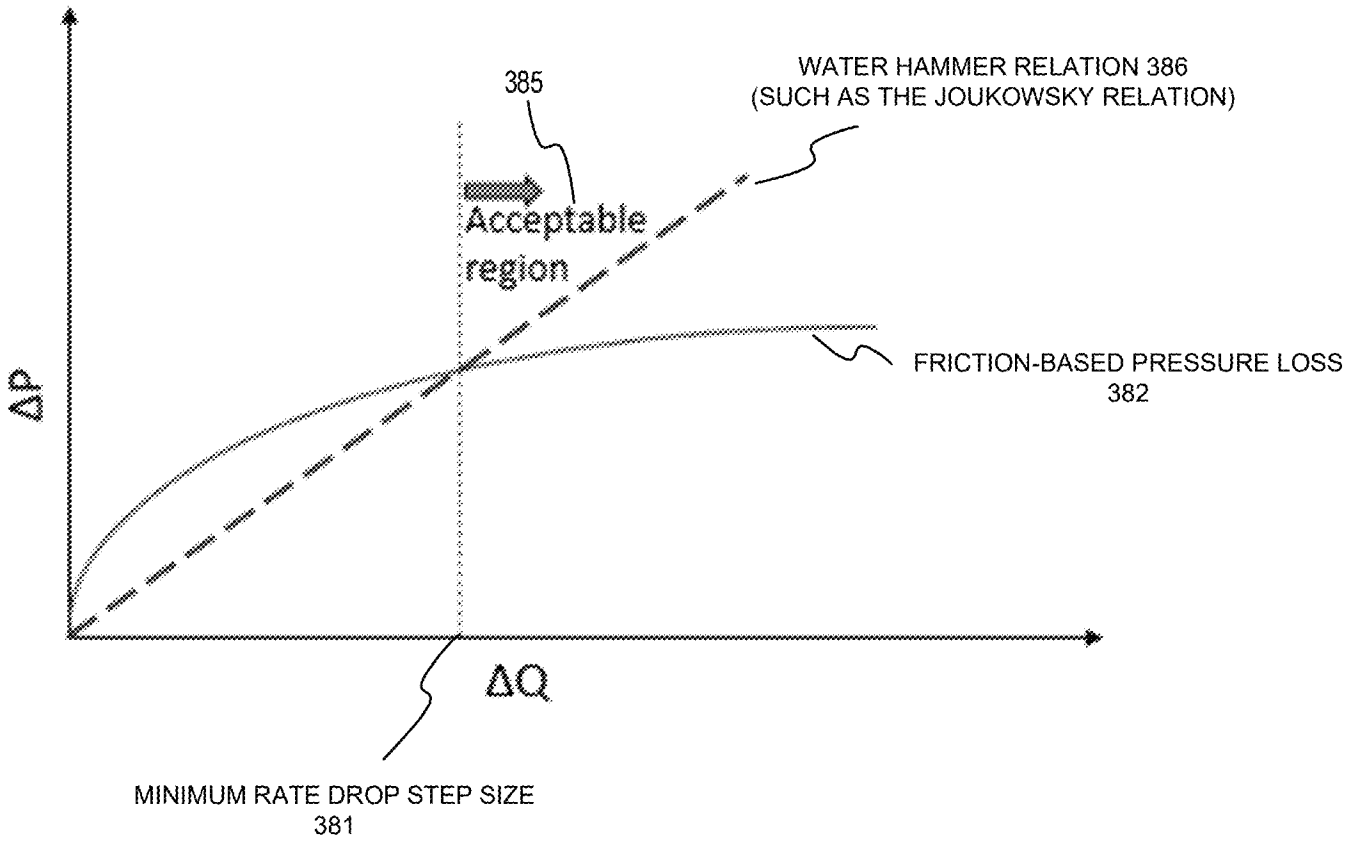
FIG. 3 depicts a plot of rate drop and pressure change relations that indicate a minimum rate drop step size that can be used for generating the target pressure signal, according to some implementations.

As shown in FIG. 3, in some implementations, the rate drop step size may be determined based on a first pressure relation or association or correlation between rate drops in the system operational rate and change in pressure due to the rate drops, and a second pressure relation or association or correlation between rate drops in the system operational rate and friction-based pressure loss due to the rate drops. For example, the first pressure relation (or association or correlation) may be represented by the water hammer relation 386 shown in FIG. 3. The second pressure relation (or association or correlation) may be represented by the friction-based pressure loss 382 shown in FIG. 3. In some implementations, the minimum rate drop step size 381 may be the smallest rate drop that is possible from the current equipment configuration (e.g., the pumping devices and operation, such as the pump 105 and the computer system 180) of the well system 100. In some implementations, the friction-based pressure loss 382 may be due to frictional dissipation and can be determined using a friction model for the fluid, for example, Darcy friction model or any other appropriate Newtonian or Non-Newtonian fluid friction model. In some implementations, the $\Delta P$ from the Joukowsky relation (e.g., the water hammer relation 386) for the rate drop $\Delta Q$ should be higher than the pressure loss from the friction (the friction-based pressure loss 382) on the amplitude. The net amplitude seen in the pressure signal may be the difference of pressure drop from the Joukowsky relation and the frictional effect on the wave. In some implementations, the minimum rate drop step size 381 for the well system may be determined based on the first pressure relation and the second pressure relation. In some implementations, the minimum rate drop step size 381 may be the $\Delta Q$ where the linear relationship plot from the Joukowsky relation (e.g., the water hammer relation 386) intersects the plot for the friction-based pressure loss 382. In some implementations, the rate drop step size for each rate drop in a sequence of multiple rate drops may be selected to be a rate drop step size that is greater than the minimum rate drop step size 381. For example, the rate drop step size may be any $\Delta Q$ within the acceptable region 385 having a value that is greater than the minimum rate drop step size 381. In some implementations, the minimum rate drop step size 381 may be too small, and thus the well system 100 may select the largest allowable rate drop step size that is greater than the minimum rate drop step size 381. In some implementations, the rate drop step size that is selected may be a rate drop step size that is greater than the minimum rate drop step size 381, and that a sequence of the selected rate drop step size achieve the target amplitude of the target pressure signal 150.

Figure 4:
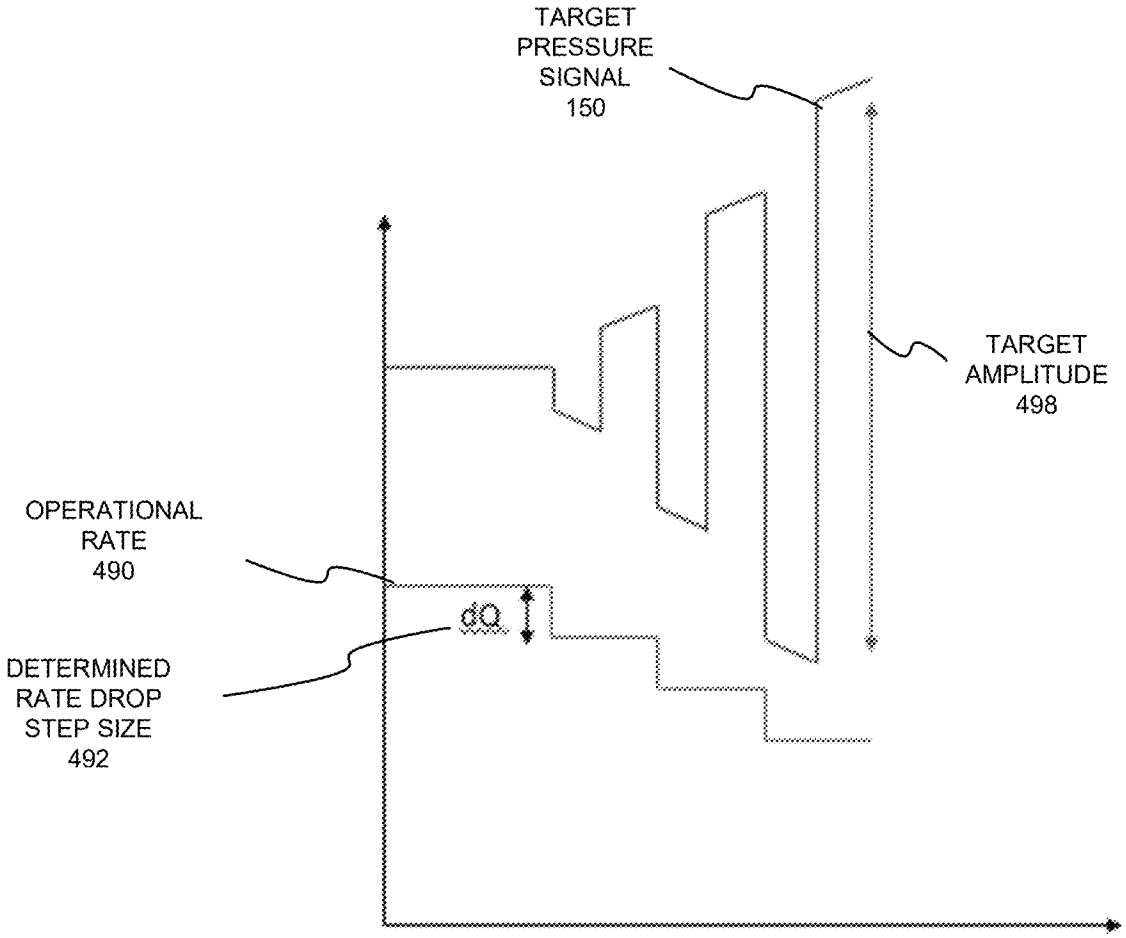
FIG. 4 depicts a plot showing the determined rate drop step size for each rate drop in the sequence of rate drops for generating the target pressure signal having the target amplitude, according to some implementations.

As shown in FIG. 4, after the rate drop step size 492 is determined (e.g., dQ or $\Delta Q$), the rate changes are performed in a sequential manner, where the pulse generated from each rate change is superimposed to amplify the overall signal to achieve the target amplitude 498 of the target pressure signal 150. In some implementations, based on the acceptable amplitude range 265 described in FIG. 2 and the minimum rate drop step size 381 shown in FIG. 3, the well system 100 may determine the rate drop step size 492 for each rate drop in a sequence of multiple rate drops that can achieve the target amplitude 498 of the target pressure signal 150. Thus, the target pressure signal 150 having the target amplitude 498 may be generated after performing multiple rate drops in sequence for the system operational rate. After the target amplitude 498 of the target pressure signal 150 is achieved, the inversion process may be performed to compute the fracturing operation metrics, such as the stage efficiency metrics for the fracturing operation. In some implementations, after generating the target pressure signal 150 having the target amplitude 498, the target pressure signal 150 may be put through an inversion algorithm to measure something in the system that is unknown, such as the stage efficiency metrics for the fracturing operation. The inversion algorithm may invert the system in order to find some unknown parameters that are associated with some fracturing operation metrics, such as stage efficiency metrics. For example, the stage efficiency metrics may indicate the efficiency of the fractures or perforations in the subsurface formation. In one non-limiting example, if the fracturing operations have created 10 perforation holes, the inversion process may ask how many of the perforation holes are taking fluid. The result may indicate that 8 of the 10 perforation holes are taking fluid and thus may indicate an 80% efficiency. This stage efficiency metric may be determined while the fracturing operations are being performed, and therefore adjustment actions may be performed by the well system 100 to improve the stage efficiency during the fracturing operations. In some implementations, a downhole operation or attribute in the wellbore (e.g., pump operation or attributes) may be modified or updated based on the determined fracturing operation metrics, such as the determined stage efficiency metrics. For example, an operation (at the surface and/or downhole) may be performed and/or directed to be performed to change a downhole operation or attribute based on the determined stage efficiency metrics or other fracturing operation metrics. For example, attributes of an actual fracking operation in the wellbore may be set based on the determined stage efficiency metrics or other fracturing operation metrics. Examples of such attributes of the actual fracking operation may include depth, composition of the proppant used for fracking, composition of the fracking fluid used for fracking, the pump rate for fracking, etc.

In some implementations, the operations described herein in FIGS. 1-4 may be automatically or autonomously performed periodically, such as (non-limiting examples) once every three hours, twice every day, or any other frequency as desired. In some implementations, the operations described herein in FIGS. 1-4 may be triggered-based when some condition or event is detected. As a non-limiting example, a certain rise or change in pressure may trigger the operations described herein in FIGS. 1-4. In some implementations, the operations described herein in FIGS. 1-4 may be manually triggered as needed. It is noted that the frequency of performing the operations described in FIGS. 1-4 may be programmable and configurable as needed based on various system implementations.

In some implementations, the well system 100 may use a learning machine (such as a machine learning model, a machine learning neural network, or other suitable particularized machine) to determine the target amplitude 498 for the target pressure signal 150 to be generated in the wellbore 102. In some implementations, the operations described above in FIGS. 1-4 that use mathematical models may instead be performed by a learning machine (or some combination of mathematical models and a learning machine) to determine the target amplitude 498 for the target pressure signal 150 (i.e., the prediction or output of the learning machine). For example, the training data set or inputs for the learning machine may include one or more of the followings: one or more of the parameters described above in FIG. 1 for analyzing the current pressure signal to determine whether it contains noise from prior system actions or operations, one or more of the parameters described above in FIG. 2 for determining the target amplitude of the target pressure signal 150, and/or one or more of the parameters described above in FIG. 3 for determining the minimum rate drop step size and selecting the rate drop step size for generating the target pressure signal 150. As another example, various rate drops may be the training data set for the learning machine and the resulting pressure response may be the output.

Various configurations for the rate drops and resulting pressure responses can be performed to build a table of inputs versus outputs that can be used to build the learning machine model. In some implementations, the learning machine or the machine learning model may include computer code and/or a neural network and be implemented on a non-transitory computer readable medium, circuitry, and/or any other logic components configured to perform the operations described herein.

Figure 5:
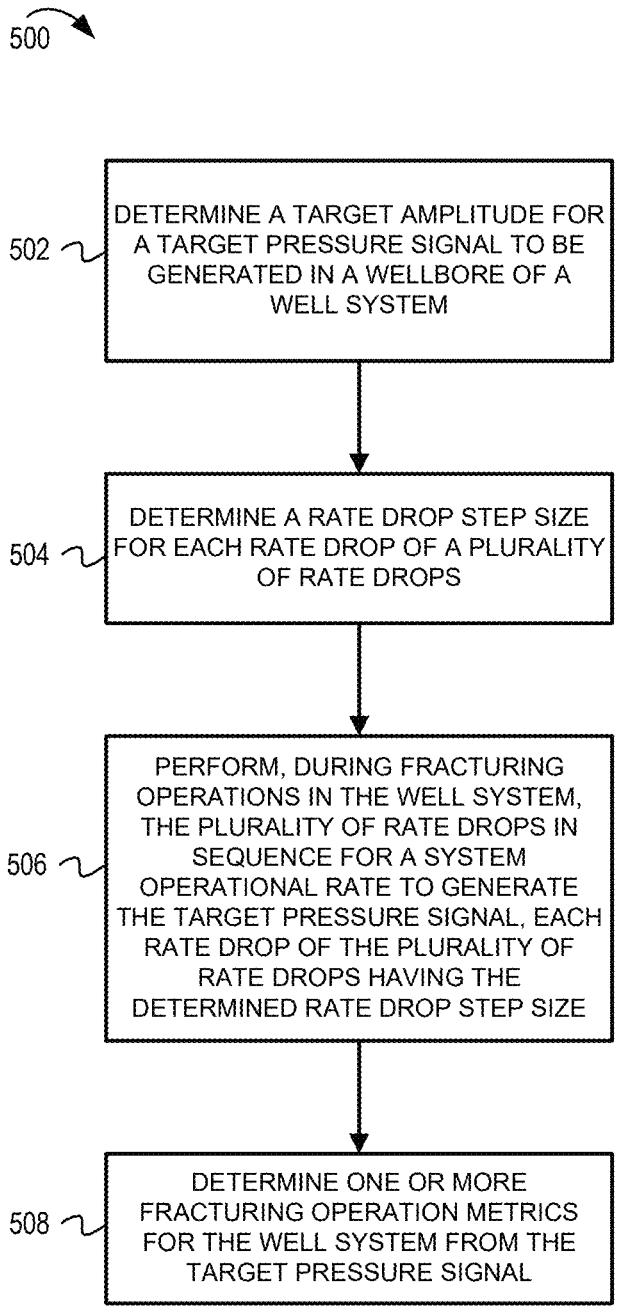
FIG. 5 is a flowchart of example operations for generating a target pressure signal from a sequence of rate drops during fracturing operations of the well system, according to some implementations.

FIG. 5 is a flowchart 500 of example operations for generating a target pressure signal from a sequence of rate drops during fracturing operations of the well system. In some implementations, a target amplitude for a target pressure signal to be generated in the wellbore of the well system may be determined (block 502). In some implementations, a rate drop step size for each rate drop of a plurality of rate drops may be determined (block 504). In some implementations, the plurality of rate drops for a system operational rate may be performed in sequence during fracturing operations in the well system to generate the target pressure signal (block 506). Each rate drop of the plurality of rate drops may have the rate drop step size. In some implementations, one or more fracturing operation metrics for the well system may be determined from the target pressure signal (block 508).

Figure 6:
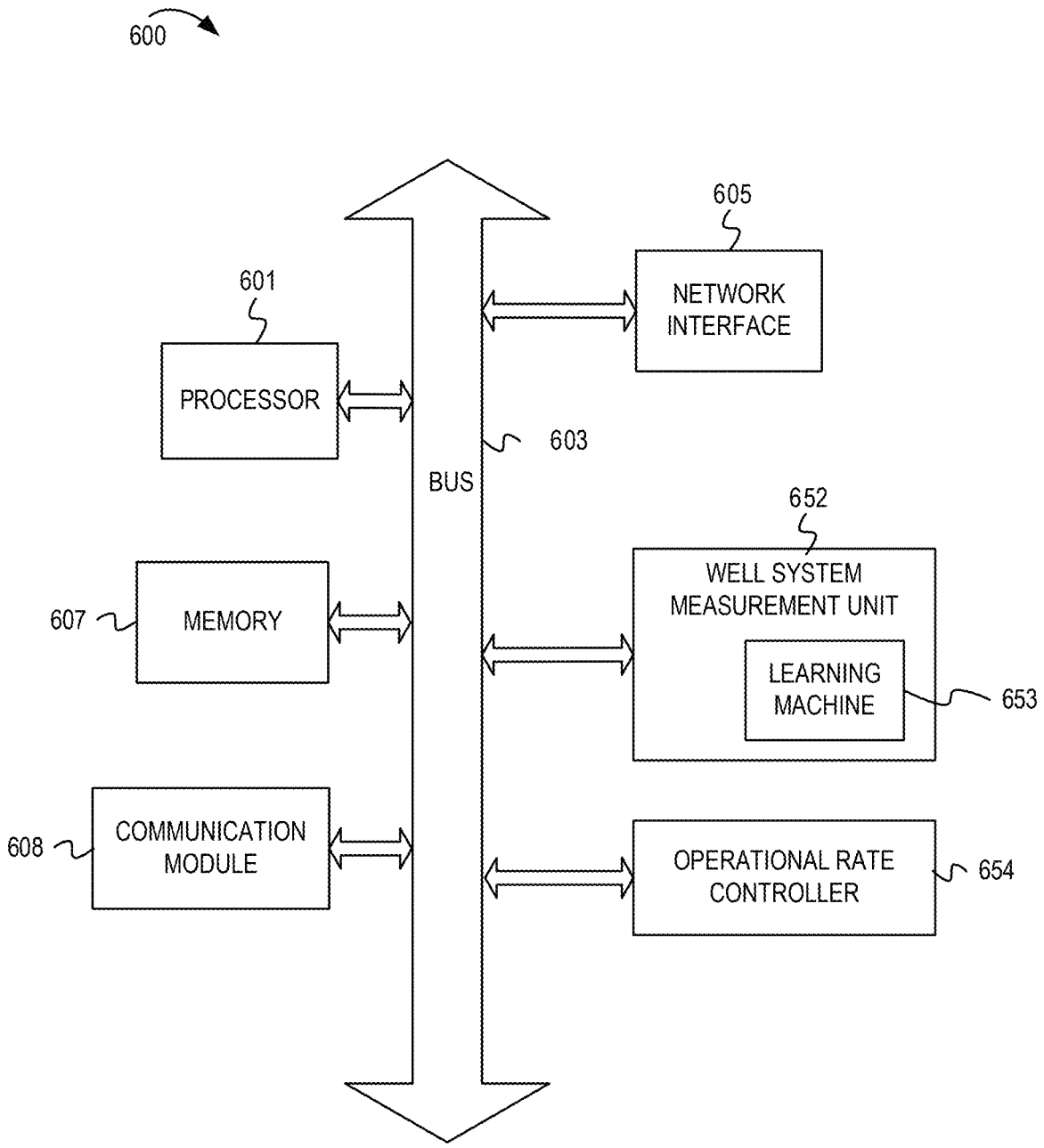
FIG. 6 depicts an example computer system that can be implemented in surface equipment of a well system for generating a target pressure signal from a sequence of rate drops during fracturing operations of the well system, according to some implementations.

FIG. 6 depicts an example computer system that can be implemented in surface equipment of a well system for generating a target pressure signal from a sequence of rate drops during fracturing operations of the well system, according to some implementations. The computer system 600 may be an example of a computer system that may be used during the operation of the well system, such as the computer system 180 shown in FIG. 1 and computer system 710 shown in FIG. 7. For example, the computer system 600 may be a standalone computer system (such as a workstation, laptop, or desktop) or may be integrated into other surface equipment of the well system. The computer system 600 may include one or more processors 601 (possibly including multiple cores, multiple nodes, and/or implementing multi-threading, etc.). The computer system 600 may include memory 607. The memory 607 may be system memory or any type or implementation of machine or computer readable media having instructions that are executable by the one or more processors 601 to implement the operations described in FIGS. 1-5. The memory 607 may be system memory or any type or implementation of machine or computer readable and writable media having the ability to receive, process and/or store measurement data from well devices and tools (including those described in FIGS. 1-5). The computer system 600 also may include a bus 603 and a network interface 605. The computer system 600 also may include a communications module 608 that may control wired and wireless communications, such as communicating with downhole devices or tools and communicating with other surface equipment. The computer system 600 also may include at least a well system measurement unit 652 and an operational rate controller 654, among other processing units or modules that are used during the operation of the well system and the well tools described herein. For example, the well system measurement unit 652 may control above ground and downhole equipment and tools to obtain measurement data (e.g., such as to obtain pressure sensor data) and store other system metrics, and may process the measurements and system metrics as described in FIGS. 1-5 to determine the target amplitude of the target pressure signal and determine the rate drop step size for each rate drop in the sequence of rate drops. The operational rate controller 654 may adjust the system operational rate during the fracturing operations of the well system by performing multiple rate drops in sequence, each rate drop having the determined rate drop step size, to generate the target pressure signal having the target amplitude, as described above in FIGS. 1-5. In some implementations, the well system measurement unit 652 (or the operational rate controller 654 or both the well system measurement unit 652 and the operational rate controller 654) may include a learning machine 653 to perform the operations described above with reference to FIGS. 1-5 for determining the target amplitude for the target pressure signal, determining the rate drop step size, performing each rate drop of the sequence of rate drops, and determining fracturing operational metrics (e.g., such as stage efficiency metrics). The functionality described herein may be implemented with an application-specific integrated circuit, in logic implemented in the processor(s) 601, in a co-processor on a peripheral device or card, etc. Further, implementations may include fewer or additional components not illustrated in FIG. 6. The processor(s) 601 and the network interface 605 may be coupled to the bus 603. Although illustrated as being coupled to the bus 603, the memory 607 may be coupled to the processor(s) 601.

Figure 7:
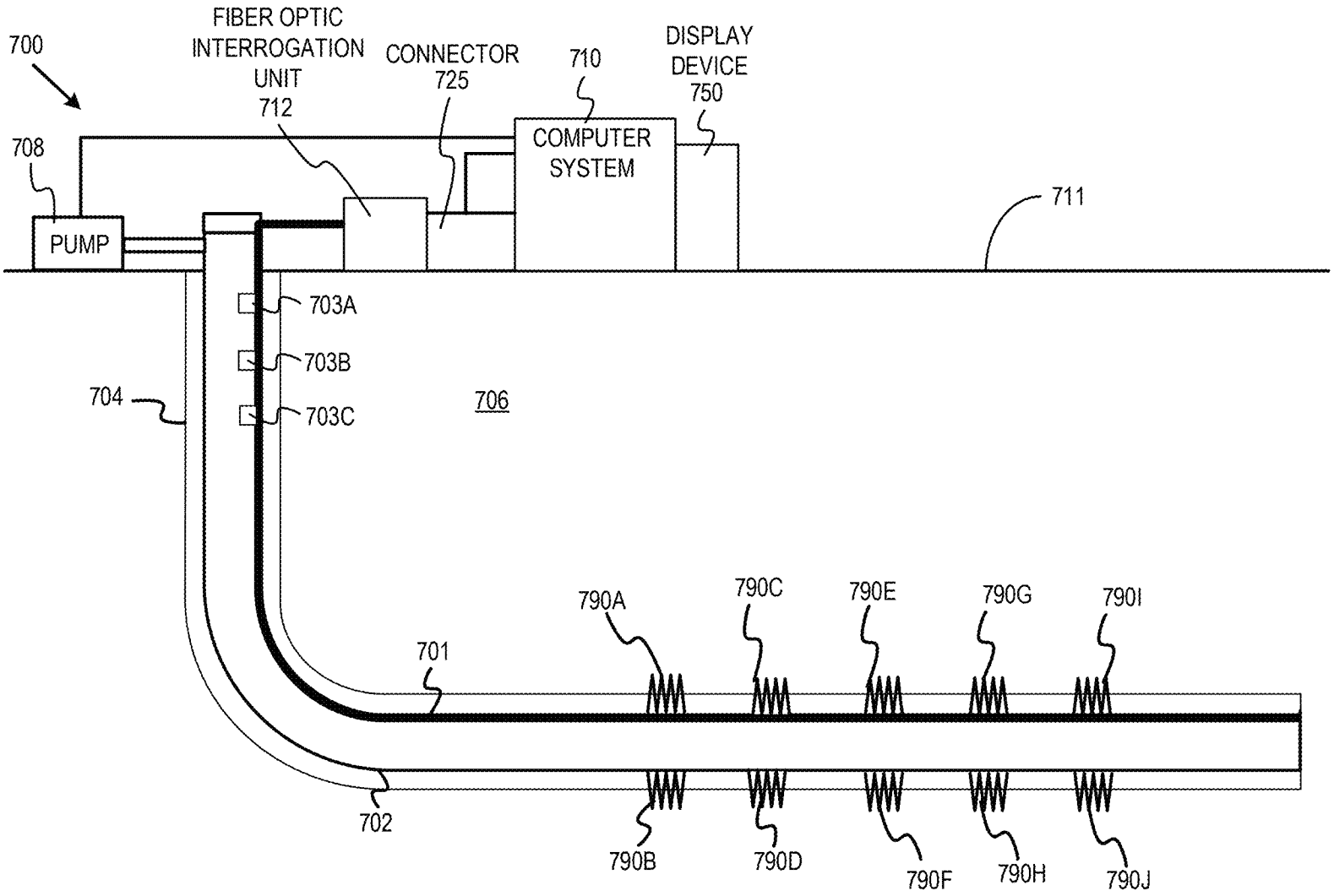
FIG. 7 is a schematic diagram of an example well system that is configured to generate a target pressure signal from a sequence of rate drops during fracturing operations of the well system, according to some implementations.

FIG. 7 is a schematic diagram of an example well system that is configured to generate a target pressure signal from a sequence of rate drops during fracturing operations of the well system, according to some implementations. A well system 700 may comprise a wellbore 704 in a subsurface formation 706. The wellbore 704 may include a casing 702 and a number of perforations 790A-790J being made in the casing 702 at different depths as part of hydraulic fracturing to allow hydraulic communication between the subsurface formation 706 and the casing 702 and to allow fracturing at different zones. The well system 700 may also include a computer 710 that is configured to perform the operations described above with reference to FIGS. 1-6 for generating a target pressure signal having a target amplitude, including operations for determining the target amplitude for the target pressure signal, determining the rate drop step size, performing each rate drop of the sequence of rate drops, and determining fracturing operational metrics. The computer 710 may be representative of the computer system 180 shown in FIG. 1 and the computer system 600 shown in FIG. 6. The well system 700 may also include one or more pumps, (such as a pump 708) that may pump fracturing fluid or fracturing treatments during the fracturing operations. The pump 708 may be representative of the pump 105 described with reference to FIG. 1. In some implementations, the computer 710 may also control the pump 708 to adjust the pumping rate when the operational rate of the well system is adjusted for generating the target pressure signal, as described above in FIGS. 1-6.

In some implementations, the well system 700 also may include a fiber optic cable 701. In some implementations, the fiber optic cable 701 may be temporarily deployed (e.g., using a deployment tool) and can be removed from the wellbore 704. In some implementations, the fiber optic cable 701 may be cemented in place in the annular space between the casing 702 of the wellbore 704 and the subsurface formation 706. In some implementations, the fiber optic cable 701 may be clamped to the outside of the casing 702 during deployment and protected by centralizers and cross coupling clamps. The fiber optic cable 701 may house one or more optical fibers, and the optical fibers may be single mode fibers, multi-mode fibers, or a combination of single mode and multi-mode optical fibers.

In some implementations, the fiber optic cable 701 may be used for distributed sensing where acoustic, strain, and temperature data may be collected. The data may be collected at various positions distributed along the fiber optic cable 701. For example, data may be collected every 1-3 ft along the full length of the fiber optic cable 701. The fiber optic cable 701 may be included with coiled tubing, wireline, loose fiber using coiled tubing, or gravity deployed fiber coils that unwind the fiber as the coils are moved in the wellbore 704. The fiber optic cable 701 also may be deployed with pumped down coils and/or self-propelled containers. Additional deployment options for the fiber optic cable 701 may include coil tubing and wireline deployed coils where the fiber optic cable 701 is anchored at the toe of the wellbore 704. In such embodiments, the fiber optic cable 701 may be deployed when the wireline or coiled tubing is removed from the wellbore 704. The distribution of sensors shown in FIG. 7 is for example purposes only. Any suitable sensor deployment may be used. For example, the well system 700 may include fiber optic cable deployed sensors or sensors cemented into the casing. Different types of sensors deployments also may be combined in a single well, such as including both sensors cemented to the casing and sensors in plugs, flow metering devices, etc. in a single well system.

In some implementations, a fiber optic interrogation unit 712 may be located on the surface 711 of the well system 700. The fiber optic interrogation unit 712 may be directly coupled to the fiber optic cable 701. Alternatively, the fiber optic interrogation unit 712 may be coupled to a fiber stretcher module, wherein the fiber stretcher module is coupled to the fiber optic cable 701. The fiber optic interrogation unit 712 may receive measurement values taken and/or transmitted along the length of the fiber optic cable 701 such as acoustic, temperature, strain, etc. The fiber optic interrogation unit 712 may be electrically connected to a digitizer to convert optically transmitted measurements into digitized measurements. The well system 700 may contain multiple sensors, such as sensors 703A-C. There may be any suitable number of sensors placed at any suitable location in the wellbore 704. The sensors 703A-C may include pressure sensors, distributed fiber optic sensors, point temperature sensors, point acoustic sensors, interferometric sensors or point strain sensors. Distributed fiber optic sensors may be capable of measuring distributed acoustic data, distributed temperature data, and distributed strain data. Any of the sensors 703A-C may be communicatively coupled (not shown) to other components of the well system 700 (e.g., the computer 710). In some implementations, the sensors 703A-C may be cemented to a casing 702.

In some implementations, the computer 710 may also receive the electrically transmitted measurements from the fiber optic interrogation unit 712 using a connector 725. The computer 710 may include a signal processor to perform various signal processing operations on signals captured by the fiber optic interrogation unit 712 and/or other components of the well system 700. The computer 710 may have one or more processors and a memory device to analyze the measurements and graphically represent analysis results on the display device 750.

In some implementations, the fiber optic interrogation unit 712 may operate using various sensing principles including but not limited to amplitude-based sensing systems like Distributed Temperature Sensing (DTS), DAS, Distributed Vibration Sensing (DVS), and Distributed Strain Sensing (DSS). For example, the DTS system may be based on Raman and/or Brillouin scattering. A DAS system may be a phase sensing-based system based on interferometric sensing using homodyne or heterodyne techniques where the system may sense phase or intensity changes due to constructive or destructive interference. The DAS system may also be based on Rayleigh scattering and, in particular, coherent Rayleigh scattering. A DSS system may be a strain sensing system using dynamic strain measurements based on interferometric sensors (e.g., sensors 703A-C) or static strain sensing measurements using Brillouin scattering. DAS systems based on Rayleigh scattering may also be used to detect dynamic strain events. Temperature effects may in some cases be subtracted from both static and/or dynamic strain events, and temperature profiles may be measured using Raman based systems and/or Brillouin based systems capable of differentiating between strain and temperature, and/or any other optical and/or electronic temperature sensors, and/or any other optical and/or electronic temperature sensors, and/or estimated thermal events.

In some implementations, the fiber optic interrogation unit 712 may measure changes in optical fiber properties between two points in the optical fiber at any given point, and these two measurement points move along the optical sensing fiber as light travels along the optical fiber. Changes in optical properties may be induced by strain, vibration, acoustic signals and/or temperature as a result of the fluid flow. Phase and intensity based interferometric sensing systems may be sensitive to temperature and mechanical, as well as acoustically induced, vibrations. The fiber optic interrogation unit 712 may capture DAS data in the time domain. Once or more components of the well system 700 may convert the DAS data from the time domain to frequency domain data using Fast Fourier Transforms (FFT) and other transforms. For example, wavelet transforms may also be used to generate different representations of the DAS data. Various frequency ranges may be used for different purposes and where low frequency signal changes may be attributed to formation strain changes or fluid movement and other frequency ranges may be indicative of fluid or gas movement. Various filtering techniques may be applied to generate indicators of events related to measuring the flow of fluid.

In some implementations, DAS measurements along the wellbore 704 may be used as an indication of fluid flow through the casing 702 in the wellbore 704. Vibrations and/or acoustic profiles may be recorded and stacked over time, where a simple approach could correlate total energy or recorded signal strength with known flow rates. For example, the fiber optic interrogation unit 712 may measure energy and/or amplitude in multiple frequency bands where changes in select frequency bands may be associated with oil, water and/or gas thus enabling multiphase production profiling along the wellbore 704.

Although example well systems are shown in FIGS. 1 and 7, it is noted, however, that the operations and tools described in FIGS. 1-7 can be used in any type of well system that performs any time of fracturing operations.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine-readable medium(s) may be utilized. The machine-readable medium may be a machine-readable signal medium or a machine-readable storage medium. A machine-readable storage medium may be, for example, but not limited to, a system, apparatus, or device, that employs any one of or combination of electronic, magnetic, optical, electromagnetic, infrared, or semiconductor technology to store program code. More specific examples (a non-exhaustive list) of the machine-readable storage medium would include the following: a portable computer diskette, a hard disk, a random-access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine-readable storage medium may be any tangible medium that can contain, or store a program for use by or in connection with an instruction execution system, apparatus, or device. A machine-readable storage medium is not a machine-readable signal medium.

A machine-readable signal medium may include a propagated data signal with machine-readable program code embodied therein, for example, in baseband or as part of a carrier wave. Such a propagated signal may take any of a variety of forms, including, but not limited to, electromagnetic, optical, or any suitable combination thereof. A machine-readable signal medium may be any machine-readable medium that is not a machine-readable storage medium and that can communicate, propagate, or transport a program for use by or in connection with an instruction execution system, apparatus, or device.

Program code embodied on a machine-readable medium may be transmitted using any appropriate medium, including but not limited to wireless, wireline, optical fiber cable, RF, etc., or any suitable combination of the foregoing.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine.

The program code/instructions may also be stored in a machine-readable medium that can direct a machine to function in a particular manner, such that the instructions stored in the machine-readable medium produce an article of manufacture including instructions which implement the function/act specified in the flowchart and/or block diagram block or blocks.

None of the implementations described herein may be performed exclusively in the human mind nor exclusively using pencil and paper. None of the implementations described herein may be performed without computerized components such as those described herein. Some implementations may perform additional operations, fewer operations, operations in parallel or in a different order, and some operations differently.

While the aspects of the disclosure are described with reference to various implementations and exploitations, it will be understood that these aspects are illustrative and that the scope of the claims is not limited to them. In general, techniques for generating a target pressure signal having a target amplitude during system operations as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations, and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

As used herein, the term "or" is inclusive unless otherwise explicitly noted. Thus, the phrase "at least one of A, B, or C" is satisfied by any element from the set {A, B, C} or any combination thereof, including multiples of any element.

Furthermore, unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well can be horizontal or even slightly directed upwards. Unless otherwise specified, use of the term "subterranean formation" shall be construed as encompassing both areas below exposed earth and areas below earth covered by water such as ocean or fresh water.

EXAMPLE EMBODIMENTS

Example Embodiments can include the following:

Embodiment #1: A method for generating pressure signals in a wellbore of a well system, comprising: determining a target amplitude for a target pressure signal to be generated in the wellbore of the well system; determining a rate drop step size for each rate drop of a plurality of rate drops; performing, during fracturing operations in the well system, the plurality of rate drops in sequence for a system operational rate to generate the target pressure signal, each rate drop of the plurality of rate drops having the rate drop step size; and determining one or more fracturing operation metrics for the well system from the target pressure signal.

Embodiment #2: The method of Embodiment #1, further comprising: prior to determining the target amplitude for the target pressure signal, determining whether a current pressure signal includes signal imprints associated with prior system operations; determining signal characteristics of the signal imprints; and removing the signal imprints from the current pressure signal based on the signal characteristics.

Embodiment #3: The method of Embodiment #1, wherein determining the target amplitude for the target pressure signal includes: determining one or more of a system instrument sensitivity, a system operational noise, a rate drop limit, and a system pressure amplitude limit; and determining the target amplitude for the target pressure signal based, at least in part, on the one or more of the system instrument sensitivity, the system operational noise, the rate drop limit, and the system pressure amplitude limit.

Embodiment #4: The method of Embodiment #3, wherein the determined target amplitude for the target pressure signal is selected from a range of amplitude values that are greater than the system instrument sensitivity and the system operational noise, and less than the rate drop limit and the system pressure amplitude limit.

Embodiment #5: The method of Embodiment #1, wherein determining the rate drop step size for each rate drop of the plurality of rate drops includes: determining a first pressure relation between rate drops in the system operational rate and changes in pressure due to the rate drops; determining a second pressure relation between the rate drops in the system operational rate and friction-based pressure loss due to the rate drops; determining a minimum rate drop step size for the well system based on the first pressure relation and the second pressure relation; and determining the rate drop step size includes selecting the rate drop step size for each rate drop of the plurality of rate drops that is greater than the minimum rate drop step size.

Embodiment #6: The method of Embodiment #1, wherein one or more of determining the target amplitude for the target pressure signal, determining the rate drop step size for each rate drop of the plurality of rate drops, performing the plurality of rate drops in sequence during fracturing operations in the well system to generate the target pressure signal, and determining fracturing operation metrics for the well system from the target pressure signal are performed using a learning machine of the well system.

Embodiment #7: The method of Embodiment #1, wherein each of the rate drops from the plurality of rate drops that are performed in sequence during the fracturing operations are superimposed with one another to generate the target pressure signal having the target amplitude.

Embodiment #8: The method of Embodiment #1, wherein each of the rate drops from the plurality of rate drops that are performed in sequence during the fracturing operations include reducing a pumping rate performed by a pump of the well system during the fracturing operations.

Embodiment #9: The method of Embodiment #1, wherein determining the one or more fracturing operation metrics for the well system from the target pressure signal includes at least determining a stage efficiency metric associated with the fracturing operations.

Embodiment #10: The method of Embodiment #1, wherein the target pressure signal includes one or more water hammer pressure pulses arising from hydraulic fracturing operations.

Embodiment #11: A well system, comprising: one or more processors; and a computer-readable storage medium having instructions stored thereon that are executable by the one or more processors to cause the well system to: determine a target amplitude for a target pressure signal to be generated in a wellbore of the well system; determine a rate drop step size for each rate drop of a plurality of rate drops; perform, during fracturing operations in the well system, the plurality of rate drops in sequence for a system operational rate to generate the target pressure signal, each rate drop of the plurality of rate drops having the rate drop step size; and determine one or more fracturing operation metrics for the well system from the target pressure signal.

Embodiment #12: The well system of Embodiment #11, further comprising instructions that are executable by the one or more processors to cause the well system to: prior to a determination of the target amplitude for the target pressure signal, determine whether a current pressure signal includes signal imprints associated with prior system operations; determine signal characteristics of the signal imprints; and remove the signal imprints from the current pressure signal based on the signal characteristics.

Embodiment #13: The well system of Embodiment #11, wherein the instructions that cause the well system to determine the target amplitude for the target pressure signal include instructions that cause the well system to: determine one or more of a system instrument sensitivity, a system operational noise, a rate drop limit, and a system pressure amplitude limit; and determine the target amplitude for the target pressure signal based, at least in part, on the one or more of the system instrument sensitivity, the system operational noise, the rate drop limit, and the system pressure amplitude limit.

Embodiment #14: The well system of Embodiment #13, wherein the determined target amplitude for the target pressure signal is selected from a range of amplitude values that are greater than the system instrument sensitivity and the system operational noise, and less than the rate drop limit and the system pressure amplitude limit.

Embodiment #15: The well system of Embodiment #11, wherein the instructions that cause the well system to determine the rate drop step size for each rate drop of the plurality of rate drops include instructions that cause the well system to: determine a first pressure relation between rate drops in the system operational rate and changes in pressure due to the rate drops; determine a second pressure relation between the rate drops in the system operational rate and friction-based pressure loss due to the rate drops; determine a minimum rate drop step size for the well system based on the first pressure relation and the second pressure relation; and determine the rate drop step size includes selecting the rate drop step size for each rate drop of the plurality of rate drops that is greater than the minimum rate drop step size.

Embodiment #16: A non-transitory computer-readable storage medium having instructions stored thereon that are executable by one or more processors of a well system, the instructions comprising: instructions for determining a target amplitude for a target pressure signal to be generated in a wellbore of the well system; instructions for determining a rate drop step size for each rate drop of a plurality of rate drops; instructions for performing, during fracturing operations in the well system, the plurality of rate drops in sequence for a system operational rate to generate the target pressure signal, each rate drop of the plurality of rate drops having the rate drop step size; and instructions for determining one or more fracturing operation metrics for the well system from the target pressure signal.

Embodiment #17: The non-transitory computer-readable storage medium of Embodiment #16, wherein prior to determining the target amplitude for the target pressure signal, further comprising: instructions for determining whether a current pressure signal includes signal imprints associated with prior system operations; instructions for determining signal characteristics of the signal imprints; and instructions for removing the signal imprints from the current pressure signal based on the signal characteristics.

Embodiment #18: The non-transitory computer-readable storage medium of Embodiment #16, wherein the instructions for determining the target amplitude for the target pressure signal include: instructions for determining one or more of a system instrument sensitivity, a system operational noise, a rate drop limit, and a system pressure amplitude limit; and instructions for determining the target amplitude for the target pressure signal based, at least in part, on the one or more of the system instrument sensitivity, the system operational noise, the rate drop limit, and the system pressure amplitude limit.

Embodiment #19: The non-transitory computer-readable storage medium of Embodiment #18, wherein the determined target amplitude for the target pressure signal is selected from a range of amplitude values that are greater than the system instrument sensitivity and the system operational noise, and less than the rate drop limit and the system pressure amplitude limit.

Embodiment #20: The non-transitory computer-readable storage medium of Embodiment #16, wherein the instructions for determining a rate drop step size for each rate drop of a plurality of rate drops include: instructions for determining a first pressure relation between rate drops in the system operational rate and changes in pressure due to the rate drops; instructions for determining a second pressure relation between the rate drops in the system operational rate and friction-based pressure loss due to the rate drops; instructions for determining a minimum rate drop step size for the well system based on the first pressure relation and the second pressure relation; and instructions for determining the rate drop step size includes selecting the rate drop step size for each rate drop of the plurality of rate drops that is greater than the minimum rate drop step size.

What is claimed is:

1. A method for generating pressure signals in a wellbore of a well system, comprising:

determining a target amplitude for a target pressure signal to be generated in the wellbore of the well system;

determining a rate drop step size for each rate drop of a plurality of rate drops;

performing, during fracturing operations in the well system, the plurality of rate drops in sequence for a system operational rate to generate the target pressure signal, each rate drop of the plurality of rate drops having the corresponding rate drop step size; and determining one or more fracturing operation metrics for the well system from the target pressure signal.

2. The method of claim 1, further comprising:

prior to determining the target amplitude for the target pressure signal, determining whether a current pressure signal includes signal imprints associated with prior system operations;

determining signal characteristics of the signal imprints; and removing the signal imprints from the current pressure signal based on the signal characteristics.

3. The method of claim 1, wherein determining the target amplitude for the target pressure signal includes:

determining one or more of a system instrument sensitivity, a system operational noise, a rate drop limit, and a system pressure amplitude limit; and determining the target amplitude for the target pressure signal based, at least in part, on the one or more of the system instrument sensitivity, the system operational noise, the rate drop limit, and the system pressure amplitude limit.

4. The method of claim 3, wherein the determined target amplitude for the target pressure signal is selected from a range of amplitude values that are greater than the system instrument sensitivity and the system operational noise, and less than the rate drop limit and the system pressure amplitude limit.

5. The method of claim 1, wherein determining the rate drop step size for each rate drop of the plurality of rate drops includes:

determining a first pressure relation between the plurality of rate drops in the system operational rate and changes in pressure due to the plurality of rate drops;

determining a second pressure relation between the plurality of rate drops in the system operational rate and friction-based pressure loss due to the plurality of rate drops;

determining a minimum rate drop step size for the well system based on the first pressure relation and the second pressure relation; and determining the rate drop step size for each rate drop of the plurality of rate drops includes selecting a rate drop step size for each rate drop of the plurality of rate drops that is greater than the minimum rate drop step size.

6. The method of claim 1, wherein one or more of determining the target amplitude for the target pressure signal, determining the rate drop step size for each rate drop of the plurality of rate drops, performing the plurality of rate drops in sequence during fracturing operations in the well system to generate the target pressure signal, and determining fracturing operation metrics for the well system from the target pressure signal are performed using a learning machine of the well system.

7. The method of claim 1, wherein each of the rate drops from the plurality of rate drops that are performed in sequence during the fracturing operations are superimposed with one another to generate the target pressure signal having the target amplitude.

8. The method of claim 1, wherein each of the rate drops from the plurality of rate drops that are performed in sequence during the fracturing operations include reducing a pumping rate performed by a pump of the well system during the fracturing operations.

9. The method of claim 1, wherein determining the one or more fracturing operation metrics for the well system from the target pressure signal includes at least determining a stage efficiency metric associated with the fracturing operations.

10. The method of claim 1, wherein the target pressure signal includes one or more water hammer pressure pulses arising from hydraulic fracturing operations.

11. A well system, comprising:

one or more processors; and a computer-readable storage medium having instructions stored thereon that are executable by the one or more processors to cause the well system to:

determine a target amplitude for a target pressure signal to be generated in a wellbore of the well system;

determine a rate drop step size for each rate drop of a plurality of rate drops;

perform, during fracturing operations in the well system, the plurality of rate drops in sequence for a system operational rate to generate the target pressure signal, each rate drop of the plurality of rate drops having the corresponding rate drop step size; and determine one or more fracturing operation metrics for the well system from the target pressure signal.

12. The well system of claim 11, further comprising instructions that are executable by the one or more processors to cause the well system to:

prior to a determination of the target amplitude for the target pressure signal, determine whether a current pressure signal includes signal imprints associated with prior system operations;

determine signal characteristics of the signal imprints; and remove the signal imprints from the current pressure signal based on the signal characteristics.

13. The well system of claim 11, wherein the instructions that cause the well system to determine the target amplitude for the target pressure signal include instructions that cause the well system to:

determine one or more of a system instrument sensitivity, a system operational noise, a rate drop limit, and a system pressure amplitude limit; and determine the target amplitude for the target pressure signal based, at least in part, on the one or more of the system instrument sensitivity, the system operational noise, the rate drop limit, and the system pressure amplitude limit.

14. The well system of claim 13, wherein the determined target amplitude for the target pressure signal is selected from a range of amplitude values that are greater than the system instrument sensitivity and the system operational noise, and less than the rate drop limit and the system pressure amplitude limit.

15. The well system of claim 11, wherein the instructions that cause the well system to determine the rate drop step size for each rate drop of the plurality of rate drops include instructions that cause the well system to:

determine a first pressure relation between the plurality of rate drops in the system operational rate and changes in pressure due to the plurality of rate drops;

determine a second pressure relation between the plurality of rate drops in the system operational rate and friction-based pressure loss due to the plurality of rate drops;

determine a minimum rate drop step size for the well system based on the first pressure relation and the second pressure relation; and determine the rate drop step size for each rate drop of the plurality of rate drops includes selecting a rate drop step size for each rate drop of the plurality of rate drops that is greater than the minimum rate drop step size.

16. A non-transitory computer-readable storage medium having instructions stored thereon that are executable by one or more processors of a well system, the instructions comprising:

instructions for determining a target amplitude for a target pressure signal to be generated in a wellbore of the well system;

instructions for determining a rate drop step size for each rate drop of a plurality of rate drops;

instructions for performing, during fracturing operations in the well system, the plurality of rate drops in sequence for a system operational rate to generate the target pressure signal, each rate drop of the plurality of rate drops having the corresponding rate drop step size; and instructions for determining one or more fracturing operation metrics for the well system from the target pressure signal.

17. The non-transitory computer-readable storage medium of claim 16, wherein prior to determining the target amplitude for the target pressure signal, further comprising:

instructions for determining whether a current pressure signal includes signal imprints associated with prior system operations;

instructions for determining signal characteristics of the signal imprints; and instructions for removing the signal imprints from the current pressure signal based on the signal characteristics.

18. The non-transitory computer-readable storage medium of claim 16, wherein the instructions for determining the target amplitude for the target pressure signal include:

instructions for determining one or more of a system instrument sensitivity, a system operational noise, a rate drop limit, and a system pressure amplitude limit; and instructions for determining the target amplitude for the target pressure signal based, at least in part, on the one or more of the system instrument sensitivity, the system operational noise, the rate drop limit, and the system pressure amplitude limit.

19. The non-transitory computer-readable storage medium of claim 18, wherein the determined target amplitude for the target pressure signal is selected from a range of amplitude values that are greater than the system instrument sensitivity and the system operational noise, and less than the rate drop limit and the system pressure amplitude limit.

20. The non-transitory computer-readable storage medium of claim 16, wherein the instructions for determining the rate drop step size for each rate drop of the plurality of rate drops include:

instructions for determining a first pressure relation between the plurality of rate drops in the system operational rate and changes in pressure due to the plurality of rate drops;

instructions for determining a second pressure relation between the plurality of rate drops in the system operational rate and friction-based pressure loss due to the plurality of rate drops;

instructions for determining a minimum rate drop step size for the well system based on the first pressure relation and the second pressure relation; and instructions for determining the rate drop step size for each rate drop of the plurality of rate drops includes selecting a rate drop step size for each rate drop of the plurality of rate drops that is greater than the minimum rate drop step size.

* * * * *